US009189000B2

(12) United States Patent
Schmeckebier et al.

(10) Patent No.: US 9,189,000 B2
(45) Date of Patent: Nov. 17, 2015

(54) METHOD FOR MONITORING AN ON-LOAD TAP CHANGER

(71) Applicants: Mario Schmeckebier, Regensburg (DE); Alexander Winterer, Lappersdorf (DE)

(72) Inventors: Mario Schmeckebier, Regensburg (DE); Alexander Winterer, Lappersdorf (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 0 days.

(21) Appl. No.: 14/382,472

(22) PCT Filed: Mar. 18, 2013

(86) PCT No.: PCT/EP2013/055539

§ 371 (c)(1),
(2) Date: Sep. 2, 2014

(87) PCT Pub. No.: WO2013/156233

PCT Pub. Date: Oct. 24, 2013

(65) Prior Publication Data

US 2015/0153749 A1 Jun. 4, 2015

(30) Foreign Application Priority Data

Apr. 16, 2012 (DE) ..... 10 2012 103 261

(51) Int. Cl.
*G05F 1/14* (2006.01)
*H01H 9/00* (2006.01)

(52) U.S. Cl.
CPC ..... *G05F 1/14* (2013.01); *H01H 9/0005* (2013.01); *H01H 2009/0061* (2013.01)

(58) Field of Classification Search
CPC ..... G05F 1/14
See application file for complete search history.

(56) References Cited

U.S. PATENT DOCUMENTS

| | | | | |
|---|---|---|---|---|
| 6,100,674 | A | 8/2000 | Dohnal | |
| 6,124,726 | A | 9/2000 | Dohnal | |
| 6,215,408 | B1 | 4/2001 | Leonard | |
| 8,013,555 | B2 * | 9/2011 | Thornell-Pers | 318/432 |

FOREIGN PATENT DOCUMENTS

DE 102010033195 B 11/2011

* cited by examiner

*Primary Examiner* — Emily P Pham
(74) *Attorney, Agent, or Firm* — Andrew Wilford

(57) ABSTRACT

The invention relates to a method for monitoring an on-load tap changer according to the known "windowing technique," wherein for synchronization, the current (I) on the diverter switch is continuously detected, the effective value (Ieff) is calculated, which in turn is differentiated. The corresponding point in time, at which the maximum or minimum of the differentiated value occurs, is evaluated to be the moment for the diverter switch leap (tLU), and produces the synchronization impulse.

3 Claims, 3 Drawing Sheets

METHOD FOR MONITORING AN ON-LOAD TAP CHANGER

CROSS REFERENCE TO RELATED APPLICATIONS

This application is the US-national stage of PCT application PCT/EP2013/055539 filed 18 Mar. 2013 and claiming the priority of German patent application 102012103261.0 itself filed 16 Apr. 2012.

The invention relates to a method of monitoring a tap changer serving for uninterrupted switching between taps of a tapped transformer.

Tap changers have been in use worldwide in large numbers for many years for uninterrupted switching between different winding taps of tapped transformers. Tapped transformers of that kind in the sense of the present invention consist of a selector for power-free selection of the respective winding tap of the tapped transformer that is to be switched to and a load changeovers switch for the actual switching from the connected to the new, preselected winding tap. The abrupt changeover, also termed load changeover switch leap, is usually carried out with the assistance of an energy store, on the triggering of which a switch shaft is rapidly rotated. The load changeover switch in addition usually comprises switch contacts and resistance contacts. In that case the switch contacts serve for direct connection of the respective winding tap with the load diverter and the resistance contacts for temporary connection, i.e. bridging by means of one or more switchover resistances.

Such a method is known from DE 197 44 465 [U.S. Pat. No. 6,124,726], that forms the preamble of claim 1 of the present invention. In this known method the torque at the drive motor is detected during actuation of the tap changer and at the same time positional detection of the respective instantaneous positions of the tap changer is carried out. Subsequently, storage of the values of the torque plot ascertained over time is carried out, wherein the torque plot is broken down into typical time ranges in each of which a separate comparison of target value and actual value is undertaken.

Thus, in the known method an association of the corresponding torques over time is undertaken that in turn corresponds with the rotational angle covered during the load changeover.

Subsequently, synchronization by means of a synchronizing pulse, which is generated at a specific defined time instant when a characteristic state in the load changeover process is reached, is carried out. The torque plot is normalized with the help of a synchronization and subsequently divided into typical time regions, i.e. the monitoring windows that correspond with defined changer-specific parts of the changeover sequence. Subsequently, a comparison of the torque values of the individual monitoring windows with previously stored characteristic target values is carried out. This resolution of the torque plot into individual windows is already the subject of the mentioned DE 197 44 465. In the outlined known method the trigger time instant of the energy store, which for its part in turn triggers the abrupt movement of the load changeover switch, is preferably used for the described synchronization and thus generation of the synchronizing pulse. This triggering of the energy store and also the subsequent load changeover switch leap represent a typical, rapidly elapsing and thus easily detectable event, which is associated with a brief time instant, in each actuation of the tap changer.

In the known method it is thus necessary, for monitoring of a tap changer by means of the "window technique," to determine the trigger instant of the energy store and thus the load changeover switch leap as accurately as possible in order to be able to derive therefrom the explained synchronization. A known switch monitoring in the tap changer or in the associated motor drive usually serves that purpose. If, however, this switch monitoring fails, synchronization is no longer possible. Moreover, there are numerous tap changers that, as supplied, do not have switch monitoring.

The absence of synchronization, however, has the consequence that due to temperature fluctuations, different breakaway torques that are dependent on rotational direction, of the drive train between motor drive and tap changer and other external influences it is possible for false torque calculations, referred to the respective time instant or the corresponding window, to occur and as a consequence thereof false or unjustified warning reports or even switching-off of the motor drive without an actual fault of the tap changer.

Moreover, a method is known from DE 10 2010 033 195 that determines the load changeover switch leap by way of a differentiated torque in a limited evaluation window. In that case, the detected torque plot for a changeover is differentiated, subsequently the minimum of the differentiated torque plot is ascertained and the time instant of the minimum, which is determined in this way, is judged to be the time instant of the load changeover switch leap that thus forms the synchronizing pulse.

However, this developed method has various disadvantages. In some tap changers the (too short) time window from the load changeover leap to standstill of the motor drive is not sufficient, so that the position of the load changeover switch leap cannot be reliably detected. In addition, it has to be taken into consideration that supply voltages, which are strongly subject to harmonics, of the motor drive lead to a noise-laden torque plot, whereby erroneous interpretations of the differentiation of the torque plot and thus differing determined positions of the load changeover switch leap are not excluded. Resulting therefrom is a significant degree of scatter that prevents reliable synchronization.

The object of the invention is to indicate a developed method of monitoring a tap changer that in simple and reliable manner enables determination of the trigger instant of the energy store and thus of the load changeover switch leap and thereby allows reliable synchronization.

This object is fulfilled by a method of monitoring a tap changer by the features of the first claim. The subclaims relate to particularly advantageous developments of the invention.

The general inventive idea consists of using the change in the load current, i.e. the current at the tap changer, during a load changeover for determination of a synchronizing pulse. The tap changer current changes within a load changeover, due to the brief electrical contact with the two adjacent winding taps of the transformer and the subsequent complete switching to the new winding tap, i.e. the next step. In accordance with the invention this current change is reproduced by a sliding effective value formation and subsequent differentiation of the effective value. Subsequently, the maximum value of the differentiated effective value of the current is determined; the time instant of its occurrence, i.e. the maximum amount, is associated with the time instant of the load changeover switch leap, thus the trigger time instant of the energy store, and utilized as synchronization time instant for the synchronizing pulse in order to thereby achieve normalization of the monitoring method to the previously defined, characteristic event, namely the load changeover switch leap, during the switching of the tap changer. As a consequence of the fact that in accordance with the invention the load changeover switch leap has thus been defined as synchronization time instant it is possible, with knowledge of the trigger time instant thereof, to subsequently determine the position of the individual windows according to the so-called window technique described in detail in DE 197 46 574 [U.S. Pat. No. 6,100,674] and thus draw conclusions about the functioning of the individual subassemblies of the tap changer such as preselector or reverser, fine selector or load changeover switch that are actuated in succession in a specific sequence in each load changeover process.

In order to compensate for possible mains disruptions and to avoid erroneous synchronizations it is particularly advantageous to additionally take into consideration the current before and after the determined maximum of the differentiated effective value. If the current before and after the detected load changeover does not differ, a load changeover has not taken place; rather, this is a mains disruption. In this case the detected value is discarded and not used for synchronization.

Moreover, in order to avoid erroneous detection it can be advantageous if the current is monitored only in an evaluation window that is narrow in terms of time and if differentiation is carried out of the effective value thereof in which the load changeover switch leap is to be expected in the case of correct functioning of the tap changer.

It is particularly advantageous with the invention that from the continuing recordal of the current it is possible to determine a load changeover, when the transformer is switched on, directly from the changing current when there is a changeover and thus independently of mechanical influences. Moreover, it is advantageous that the method according to the invention can be used even in the case of manual actuation of the tap changer, i.e. in the case of hand-cranked operation without an electrically moved motor drive. This is not possible in the prior art.

The method according to the invention for monitoring a tap changer shall be explained in more detail in the following by way of example on the basis of drawings, in which.

In the following description of the method of monitoring a tap changer essentially the method steps according to the invention for determination of the trigger time instant of the energy store are explained in detail. The remaining method steps are indeed mentioned, but presumed to be known to the relevant expert, since they are already explained in German Patent Specifications DE 197 46 574, DE 197 44 465 and DE 10 2010 033 195 attributable to the applicant.

Figure 1:
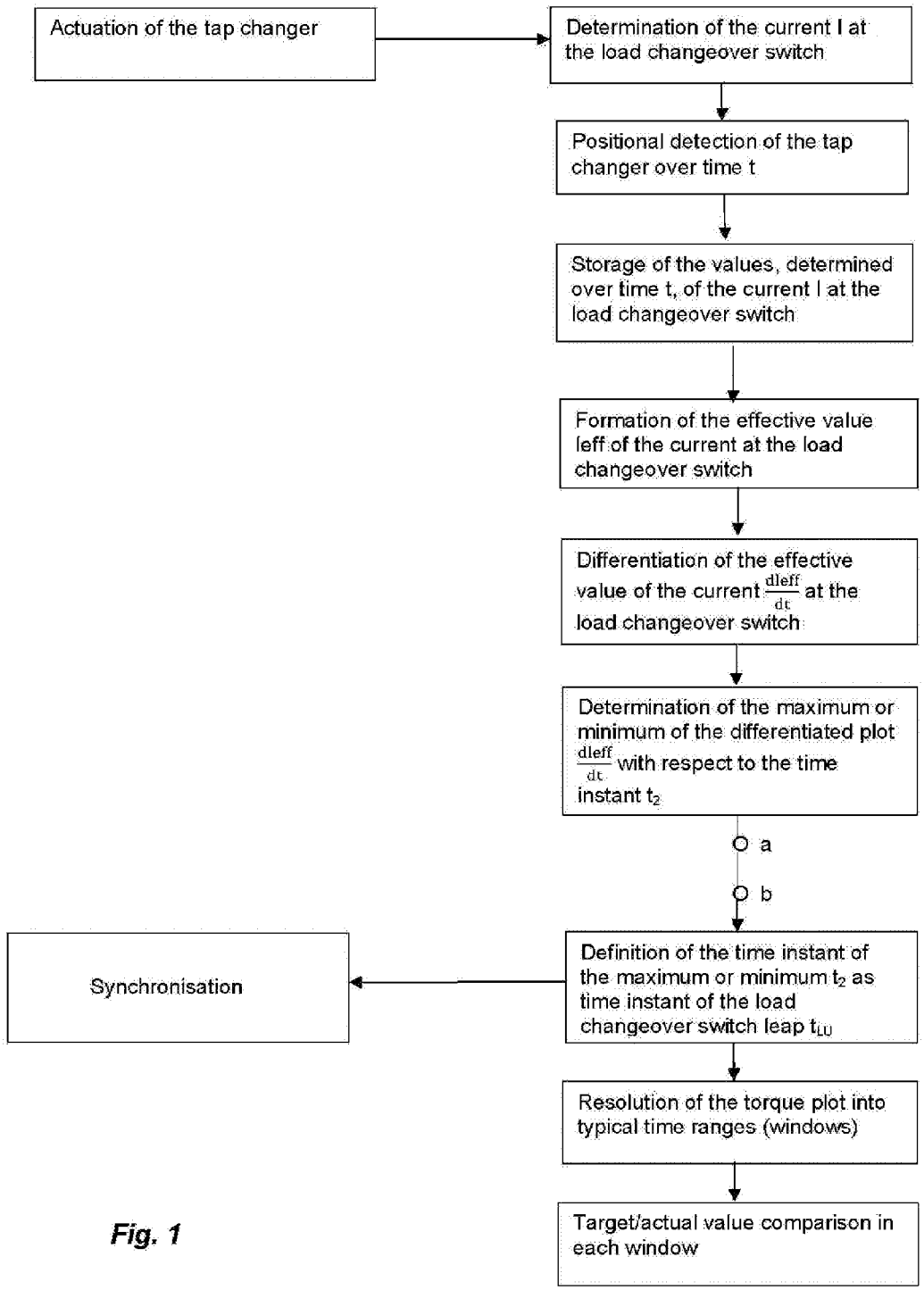
FIG. 1 shows a schematic flow chart of a method according to the invention.

The method according to the invention is schematically illustrated in FIG. 1. In the case of actuation of the tap changer, i.e. initiation of a changeover process from one winding tap to another, adjacent tap, initially a current I present at a load changeover switch of the tap changer is determined. Various means for that purpose are available in the prior art.

Taking place next, in known manner, is positional detection of the tap changer, i.e. its relative setting over the time t during the complete changeover process. It is possible to derive therefrom the instantaneous position in which the individual subassemblies such as a preselector, selector and load changeover switch are disposed within the entire switching sequence to be performed. This positional detection is carried out particularly advantageously by means of a resolver that allows continuous detection. In addition, the torque of a drive motor belonging to the tap changer is detected during the actuation. This can be determined in particularly simple manner if, for example, the effective value of the current and voltage of the drive motor associated with the tap changer are detected in order to determine therefrom in a manner known per se the effective power so as to in turn calculate therefrom the corresponding torque. Subsequently, storage of the values, which are determined over the time t, of the current I at the load changeover switch is carried out.

Moreover, in accordance with the invention formation of the effective value $I_{eff}$ of the current I of the load changeover switch is subsequently carried out. This takes place continuously.

The effective value $I_{eff}$ of the current at the load changeover switch is subsequently differentiated; this gives $dI_{eff}/dt$. Subsequently, in turn the maximum or the minimum of the differentiated plot $dI_{eff}/dt$ is sought and assigned to the corresponding time instant $t_2$ at which it occurs. The basis for that is that depending on whether a rising or falling current plot is connected with the load changeover switch leap a maximum or a minimum arises in the differentiated plot. In other words: in accordance with the invention the (sign-free) maximum of the amount is determined. This time instant of the occurrence of the maximum or minimum $t_2$ is defined as time instant of the load changeover switch leap $t_{LU}$, thus the trigger time instant of the energy store. An unambiguous synchronization time instant is thus determined. The synchronization is undertaken.

Subsequently thereto—after successful synchronization—breaking down of the torque plot of the drive motor into typical time ranges, i.e. "windows," is carried out in known manner. In that case, each window corresponds with a characteristic part of the respectively elapsing switching-over sequence. Such windows can comprise, for example, the time period of actuation of the preselector, the fine selector or also the load changeover switch. Each window is then bounded by two respective characteristic time instants that establish the start and end of the window in terms of time: $t_0$-$t_1$, $t_1 \ldots t_{syn}$-$t_n$. Each of these windows is compared with previously stored characteristic target values. Through the selective comparison method it is possible to not only detect a deviation of the actual and target values of the torque and thus a fault, but also thereby assign a fault that has occurred to a specific subassembly that has caused it, in order to thereby make conclusions about the functioning of the individual subassemblies of the tap changer such as preselector or reverser, fine selector or load changeover switch that are actuated in a specific sequence in succession with each load changeover.

Figure 2:
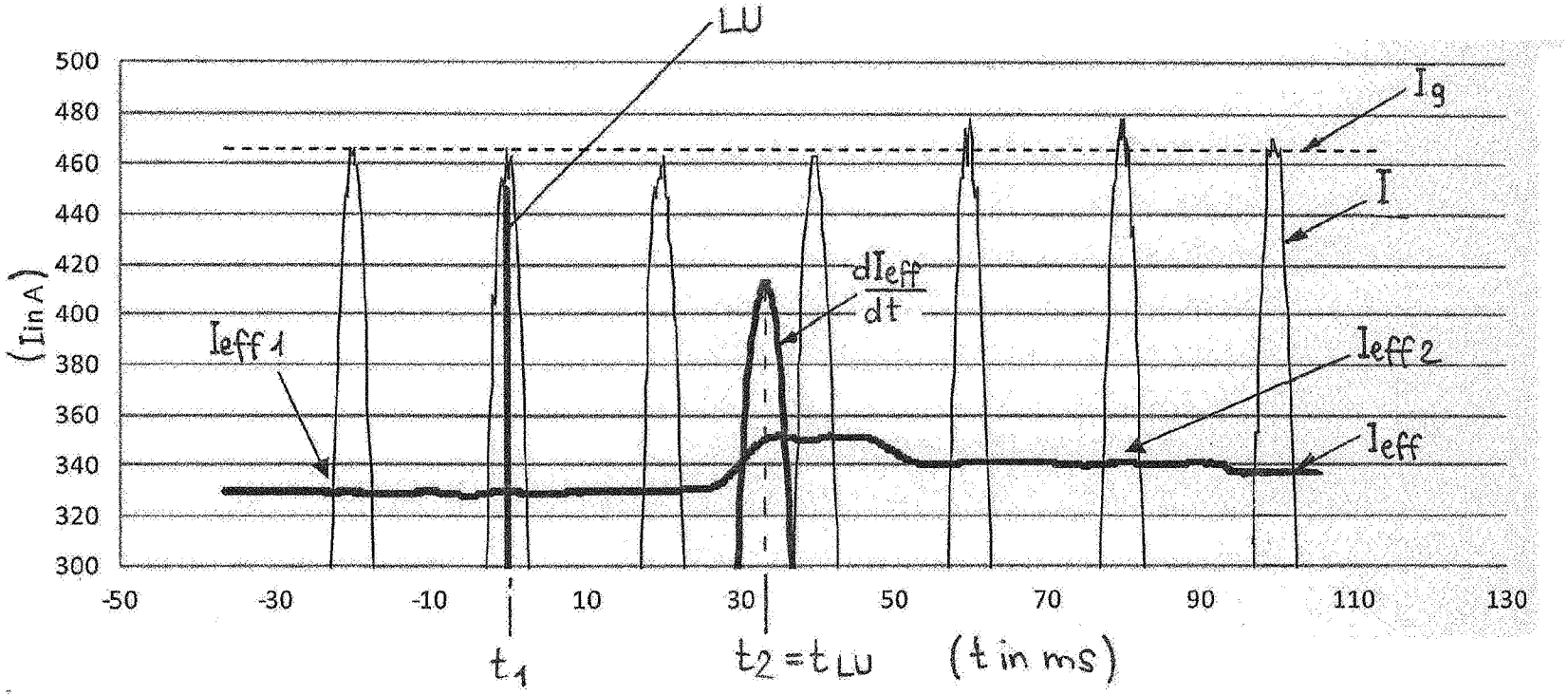
FIG. 2 shows the typical plot of current as well as the corresponding plots after differentiation in accordance with the method according to the invention when load changeover of the tap changer takes place.

FIG. 2 shows in schematic illustration the corresponding plots during a changeover. Shown initially is the respective current I at the load changeover switch, in addition its upper limit value $I_g$. This current I is initially subjected to an effective value formation; the respectively resulting effective value $I_{eff}$ is illustrated by a thick line. At a time instant $t_1$ the load changeover switch LU is actuated and the actual load changeover process begins. After a specific time period the actual electrical switching between the winding taps then begins. A differentiation of the effective value $dI_{eff}/dt$ is carried out as already explained. Similarly illustrated by a thick line is the maximum briefly arising during the load changeover.

The background thereto is that during the actual load changeover the current I at the tap changer and thus also its effective value $I_{eff}$ briefly increase due to the temporary electrical contact of the load changeover switch contacts with two winding taps, namely the previous tap and the new tap that is to be switched to. This is known prior art with all tap changers according to the principle of the resistance fast-action changer and familiar to the expert. This temporary, rapid current increase, that, as explained, is due to the functioning, leads to a maximum of the differentiated value $dI_{eff}/dt$. The time instant of occurrence of the illustrated maximum $dI_{eff}/dt$ is associated with a time instant $t_2$ and according to the invention judged to be the time instant of the load changeover switch leap $t_{LU}$ that is the basis of the subsequent synchronization.

It can be seen that prior to the actual load changeover the effective value of the current $I_{eff1}$ is higher or lower than the effective value of the current $I_{eff2}$ after the load changeover. Whether it is higher or lower depends on the direction in which the tap changer is actuated, i.e. whether a voltage increase or a voltage reduction takes place.

Figure 3:
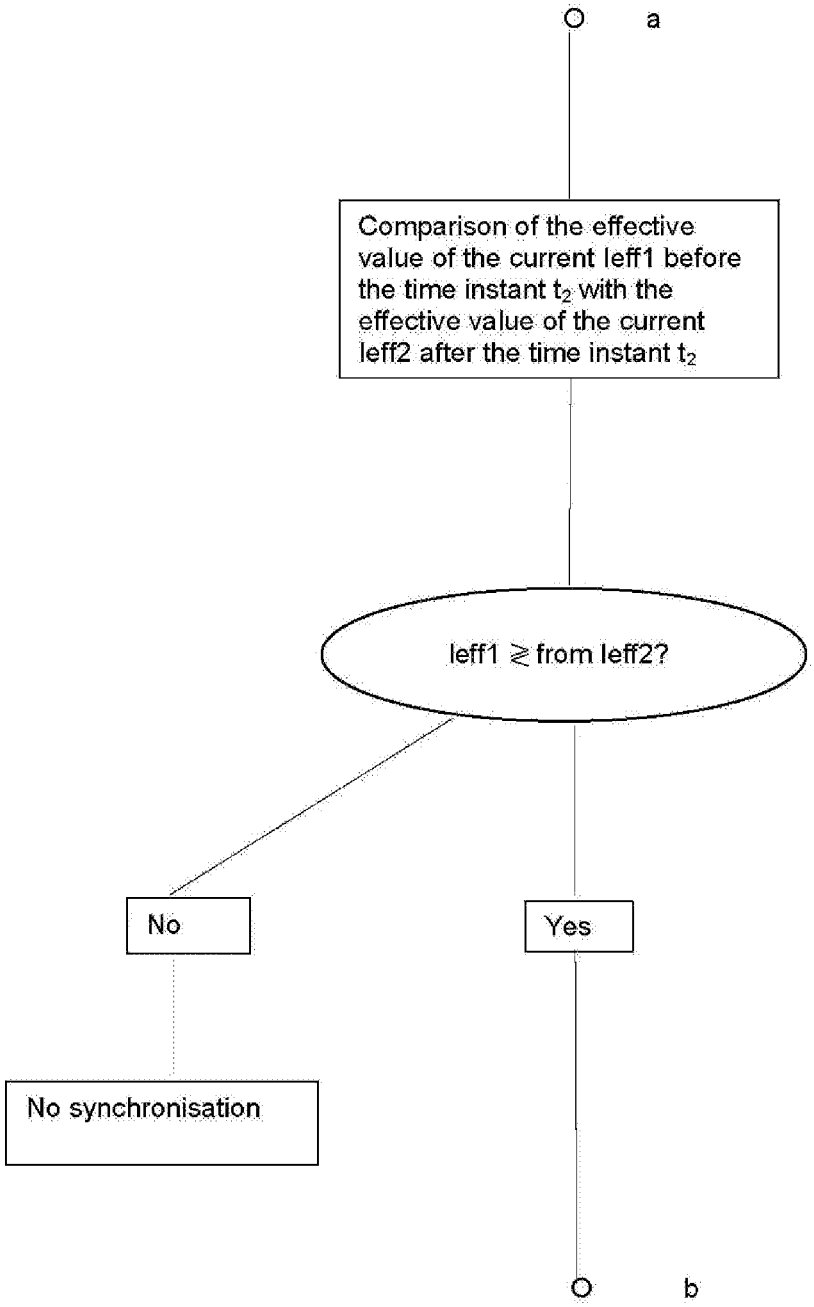
FIG. 3 shows an advantageous development of the method according to the invention illustrated in FIG. 1.

This effect can be usefully employed for development of the method according to the invention that is illustrated in FIG. 3. In that case, the sub-method shown in FIG. 3 is additionally inserted between the time instants, which are denoted by a and b in FIG. 1, of the method sequence according to the invention. The effective value of the current $I_{eff1}$ before the time instant $t_2$ is then compared with the effective value of the current $I_{eff2}$ after the time instant $t_2$. If the two effective values $I_{eff1}$ and $I_{eff2}$ significantly differ from one another that is an indication of a correct load changeover and the determined time instant $t_2$ is assumed as time instant of the load changeover switch leap $t_{LU}$ and serves for the synchronization. If this is not the case, it is assumed that a load changeover cannot have taken place. This can suggest possible mains disruption; in such a case synchronization does not take place, since the underlying time instant $t_2$ in such a case is unreliable and does not represent a time instant of a load changeover.

Equally, it is possible within the scope of the invention to undertake monitoring of the current I only in a time (specific to tap changer) evaluating window in which—in the case of correct functioning of the tap changer—the load changeover switch leap is expected.

The time instant of a load changeover, when the transformer is switched on, can thus be very precisely ascertained from the continuous determination of current I and subsequent effective value formation and differentiation in accordance with the invention; moreover, it is independent of mechanical influences.

A further advantage of the method according to the invention is that it is also usable in the case of hand-crank operation, i.e. without electrically moved motor drive.

The invention claimed is:

1. A method of monitoring a tap changer, the method comprising steps of:

detecting a torque at a drive motor during actuation of the tap changer while simultaneously detecting a position of a respective instantaneous position of the tap changer at a same time, thereafter storing values of a torque plot ascertained over time, synchronizing by a synchronizing pulse is subsequently carried out, subdividing the torque plot into typical time ranges in each of which a separate comparison of target value and actual value is undertaken, continuously determining a current I present at a load changeover switch, subsequently continuously determining an effective value $I_{eff}$ of the current I at the load changeover switch, subsequently differentiating the respective effective value $I_{eff}$ of the current at the load changeover switch in such a manner that a differentiated plot $dI_{eff}/dt$ is given, and subsequently determining and assigning a maximum of an amount of the differentiated plot $dI_{eff}/dt$ to a corresponding time instant $t_2$ at which it occurs and employing the corresponding time instant $t_2$ of the occurrence of the maximum of the amount as time instant of the load changeover switch leap $t_{LU}$ in order to utilize this as synchronization time instant for the synchronizing pulse.

2. The method according to claim 1, further comprising a step, after the maximum of the differentiated plot dIeff/dt has been determined and assigned the corresponding time instant $t_2$ at which it has occurred, of:

comparing a first effective current $I_{eff1}$ before the corresponding time instant $t_2$ with a second effective current $I_{eff2}$ after the corresponding time instant $t_2$ and assuming $t_2$ to be a time instant of the load changeover switch leap $t_{LU}$ to serve for the synchronization only if the first effective current $I_{eff1}$ and the second effective current $I_{eff2}$ significantly differ from one another.

3. The method according to claim 1, wherein said determining the current I is undertaken only in a time evaluation window in which the load changeover switch leap $T_{lu}$ is expected, the time evaluation window being specific to the tap changer.

* * * * *